United States Patent [19]

Pool

[11] 4,326,647

[45] Apr. 27, 1982

[54] DEVICE FOR DISPENSING FLUENT MATERIAL FROM A COLLAPSIBLE CONTAINER

[76] Inventor: Daniel L. Pool, 5524 N. 39th Ave., Phoenix, Ariz. 85019

[21] Appl. No.: 152,426

[22] Filed: May 22, 1980

[51] Int. Cl.[3] ..... B65D 35/28

[52] U.S. Cl. ..... 222/103; 222/105

[58] Field of Search ..... 222/92, 93, 95, 103, 222/106, 105

[56] References Cited

U.S. PATENT DOCUMENTS

| | | | |
|---|---|---|---|
| 3,155,278 | 11/1964 | Le Baron | 222/03 |
| 3,241,721 | 3/1966 | Freeman | 222/93 |
| 3,675,822 | 7/1972 | Casali et al. | 222/103 |

FOREIGN PATENT DOCUMENTS

| | | | |
|---|---|---|---|
| 2655745 | 6/1978 | Fed. Rep. of Germany | 222/103 |

*Primary Examiner*—Joseph J. Rolla
*Attorney, Agent, or Firm*—Don J. Flickinger

[57] ABSTRACT

A housing carries an anvil having an upper surface for supporting the deformable body of a collapsible tube. The header wall of the tube bears against the forward end wall of the housing which is spaced from the forward end of the anvil. An elongate presser element having a rearward end pivotally connected to the housing includes a surface which is arcuately movable relative the surface of the anvil. The presser element is moved toward the anvil to squeeze fluent material from the tube in response to pressure exerted upon an elongate actuating element bearing upon the presser element and having a pivotally connected end proximate the forward end of the housing. An article storage compartment located below the anvil is accessible through a door carried at the rear of the housing.

12 Claims, 18 Drawing Figures

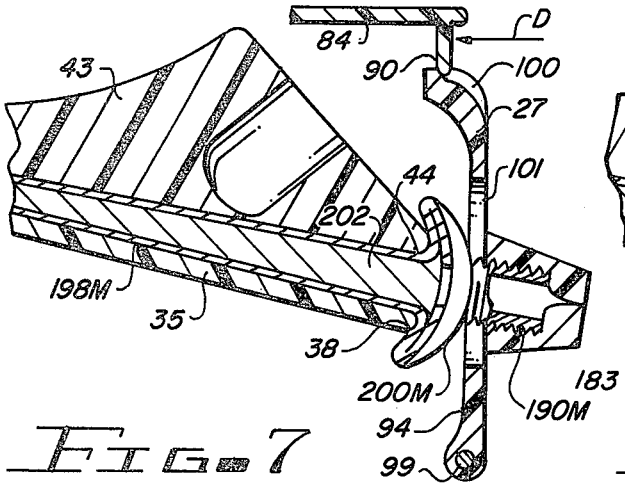
FIG. 7
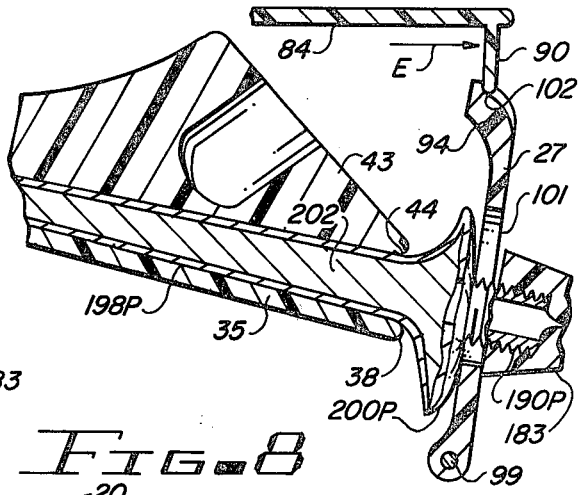
FIG. 8
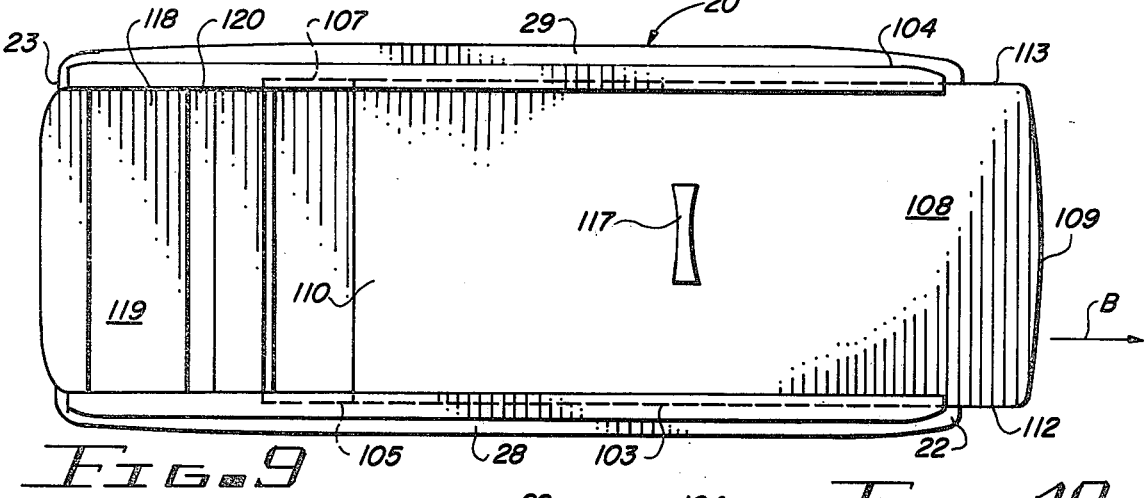
FIG. 9
FIG. 10
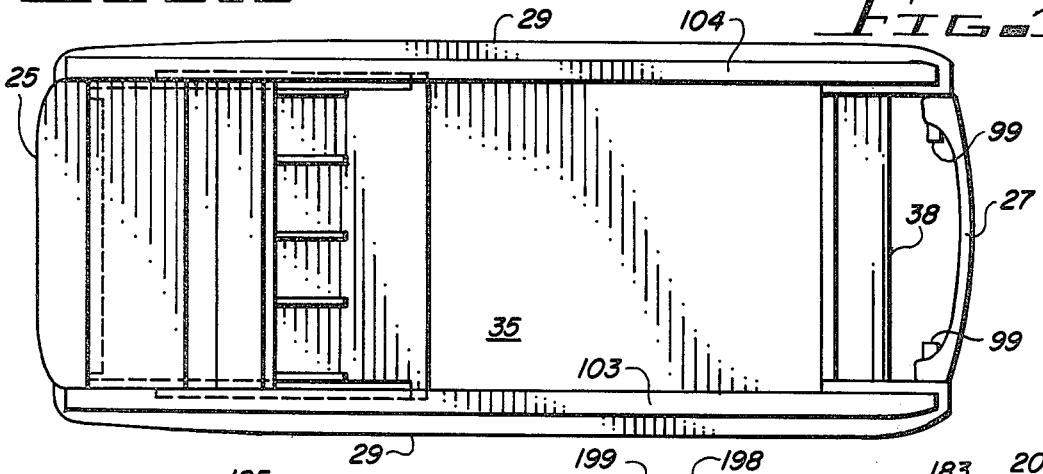
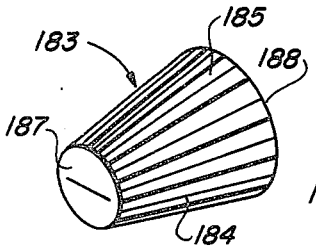
FIG. 11
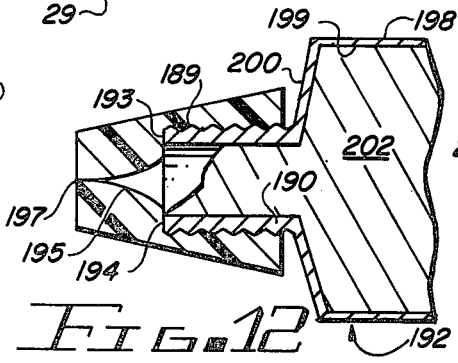
FIG. 12
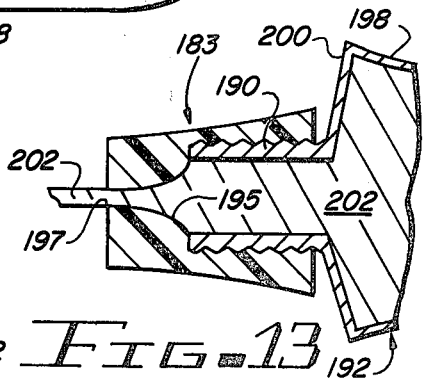
FIG. 13

DEVICE FOR DISPENSING FLUENT MATERIAL FROM A COLLAPSIBLE CONTAINER

FIELD OF THE INVENTION

This invention relates to dispensing devices.

In a further aspect, the present invention relates to devices for holding and dispensing fluent material.

More particularly, the instant invention concerns a dispenser for squeezing fluent material from a replacably held collapsible tube.

DESCRIPTION OF THE PRIOR ART

Various commonly used fluent mateials are frequently packaged in collapsible containers. Materials of the type include utility or hardware substances such as adhesives, lubricants and sealants. Also included are toilet or personal grooming preparations exemplified by dentifrices, hair creames, and body lotions.

The typical collapsible container, colloquially referred to as a tube, includes a deformable body having a continuous side wall with a closed end and an open end. A header wall, usually circular, extends across and sealingly closes the open end of the body. Extending from the header wall is a discharge spout to which a closure element or cap is detachably affixed.

While analogous in shape and function, collapsible containers, or tubes, are produced from various materials. The traditional material is a soft metal, such as lead. Recently, pliable plastic has become increasingly popular. In either case, the header wall is fabricated of a thicker material than the body in order to provide a somewhat more rigid element. After introduction of the fluent material, the closed end is formed by sealing the body along a substantially straight line.

Utilization of a tube of the foregoing type is exceedingly simple. The user simply removes the cap, directs the discharge spout as desired, and squeezes the collapsible body. The fluent material spews forth in a continuous stream or ribbon until pressure upon the body is relaxed. Thereafter, the cap is replaced and the container layed aside for subsequent use.

Ideally, for maximum retrival of contents, the tube is progressively squeezed. That is, the tube is squeezed at the closed end with successive squeezings advancing toward the header wall. Concurrently, the tube may be progressively rolled about the sealing line. Manipulation of the tube in this manner ensures progressive collapse of the body and continuous urging of all material toward the header wall.

In actuality, however, the tube is usually squeezed at random locations in a haphazard manner. As a result, pockets of fluent material are bypassed. To obtain as much of the contents as possible, users may expend considerable time and effort flattening, pressing and manipulating an otherwise empty container to push th bypassed fluent material toward the discharge spout. Others, with less time or patience, simply discharge the tube along with the remaining contents.

Other inconveniences and annoyances associated with the use of collapsible containers are well recognized. Aesthetically, a partially used tube leaves much to be desired. Tubes are generally stored in drawers or cabinets and, therefore, are not readily available for use. Manipulation is also frequently difficult since the user's hands may be rendered slippery from soap or other lubricant. Another manipulative difficulty is encountered while attempting to replace the cap after use while holding the tube in one hand and the recipient of the fluent material in the other. Any manipulation, is strenuous for persons with impaired hand use or diminished hand strength.

Further, it is known that the technique for use of one type of tube, metal or plastic, is not entirely applicable to the other. For example, the entire body of a metal tube can be flattened for the purpose of discharging the fluent material. Flattening of the body adjacent the header wall will, obviously, materially deform the header wall. Such flattening of a plastic tube, on the other hand, will cause tearing along the junction between the body and the header wall.

In an attempt to provide solutions for at least some of the foregoing problems, the prior art has provided numerous holders, dispensers, and squeezers for use in combination with collapsible containers. A search of records within the United States Patent and Trademark Office to locate references setting forth devices related to the instant invention revealed the following issued United States Patents:

| | |
|---|---|
| 1,558,195 McEnaney | 1,583,813 Thwaites |
| 1,688,512 Walker | 2,960,092 Francolino |
| 3,194,440 Watson, Jr. | 3,405,843 Watson, Jr. |
| 3,414,166 Martin | |

U.S. Pat. No. 1,558,195 discloses a dentrifrice receptacle having a cylindrical body with open ends and with an intermediate partition to form a pair of compartments. A toothbrush is detachably held within one of the compartments. A collapsible tube is held in the other compartment. Resting upon the tube is an elongate pressure chamber fabricated of a flexible material. One end of a pivotally mounted lever urges the presser member downwardly in response to the other end being lifted upwardly.

U.S. Pat. No. 1,583,813 discloses a toothpaste dispenser having an upright cylindrical casing which encloses a collapsible tube. In response to pressure against a lever mounted on the side of the casing, a button is pressed into the side of the tube and, concurrently, a cover plate at the end of the discharge spout of the tube is actuated. Also provided is a key extending through a longitudinal slot within the casing for rolling the tube from the closed end.

U.S. Pat. No. 1,688,512 discloses a toothpaste dispensing device including a carrier tube with end caps. A toothbrush and a collapsible tube are held within the carrier tube. A pair of rollers are advanced along the tube thus flattening the tube and urging the contents therefrom.

U.S. Pat. No. 2,960,092 discloses a dental kit including a tubular case for enclosing a toothbrush. A collapsible tube is held in a trough formed integrally with and extending along the tubular case. An ejector, slidably carried within the trough, is moved along the tube for flattening the tube and urging the contents therefrom.

U.S. Pat. No. 3,194,440 discloses a plurality of tube squeezers and holder therefor. A flexible tube is positioned between the two flexible tabs which extend through a squeezing block and connected with an operating handle. With each stroke of the operating handle, the squeezing block is moved forwardly to effect the dispensing action.

U.S. Pat. No. 3,405,843 discloses a container-dispenser for collapsible tubes having a case for holding said tube. At the forward end of the case is a sunction pump to which is secured the discharge spout of the tube. Operation of the pump is effected by an associate handle.

U.S. Pat. No. 3,414,166 discloses a device for dispensing material from collapsible container means including a housing for holding the tube in an upright position with the discharge spout extending through the lower end thereof. A knob projecting from the side of the housing is carried by a shaft which is affixed to one of a pair of rollers which advance along and flatten the tube.

None of the foregoing devices, however, has provided an entirely satisfactory solution to the foregoing problems. Therefore, it would be highly advantageous to remedy the deficiencies inherent in the prior art.

Accordingly, it is an object of the present invention to provide an improved dispenser for collapsible containers.

Another object of the invention is the provision of a dispenser for squeezing fluent material from a tube.

And another object of the invention is to provide a dispenser which will progressively collapse the body of a tube.

Still another object of this invention is the provision of squeezing means which is effectively usable with containers fabricated of various materials.

Yet another object of the invention is the provision of a dispenser which is usable with tubes of differing lengths.

And still another object of the invention is to provide a dispenser which can be easily manipulated, such as by persons with impaired hand use.

A further object of the invention is the provision of a dispenser for storing a tube at a selected, convenient, readily usable location.

And a further object of the instant invention is to provide a dispenser which does not have to be held or stabilized during use.

Still a further object of the invention is the provision of a device which dispenses a determinable quantity of fluent material in response to minimal manual pressure.

And still a further object of the invention is to provide a dispenser of the above type having integral storage facilities for selected items.

SUMMARY OF THE INVENTION

Briefly, to achieve the desired objects of the instant invention in accordance with a preferred embodiment thereof, provided is a housing having a well for receiving a collapsible container. An anvil, extending longitudinally within the housing, supports the deformable body of the container, the discharge spout of which extends through an opening in the forward end wall of the housing. Lever means, carried by the housing and opposing the anvil, progressively collapses the deformable body from the closed end thereof urging fluent material from the discharge spout.

In accordance with a more specific embodiment of the invention, the anvil includes an inclined surface having a rearward end being elevated above the forward end. The header wall of the collapsible container resides forward of the forward end of the inclined surface and bears against the forward end wall. The lever means includes an elongate pressure element angularly movable relative the anvil and an actuating element carried by the housing. The actuating element, in response to manual pressure, urges the presser element towards the anvil.

In a further embodiment, the presser element is elongated having a rearward end pivotally connected to the housing proximate the rearward end of the anvil. The actuating element, also elongated, is pivotally connected at one end proximate the foreward end of the housing and extends over the presser element. The forward end wall of the housing is movable relative the forward end of the surface of the anvil between a first position, especially adapted for use with plastic tubes, and a second closer spaced position especially adapted for use with metal tubes. Storage for selected items is in a compartment below the anvil and accessible through a door at the rearward end of the housing.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which:

FIG. 7 is a fragmentary portion of the forward end of the illustration of FIG. 4 illustrating the arrangement of components thereof as they would appear when in use with a conventional metallic tube;

FIG. 8 is an illustration generally corresponding to the illustration of FIG. 7 except showing the device in use with a conventional plastic tube;

FIG. 9 is a bottom view of the device of FIG. 1 and showing the bottom tray in a partially removed position;

FIG. 10 is a view generally corresponding to the view of FIG. 9 except for complete removal of the tray;

FIG. 11 is a perspective view of an alternate cap for a collapsible tube especially useful in combination with the dispenser of the instant invention FIG. 12 is a vertical sectional view of an end of a conventional collapsible tube particularly showing the device of FIG. 11 in use therewith in a closed position;

FIG. 13 is a view generally corresponding to that shown in FIG. 12 except taken during a period during which fluent material is being discharged from the tube;

DETAILED DESCRIPTION OF THE PREFERRED EMBODIMENTS

Figure 1:
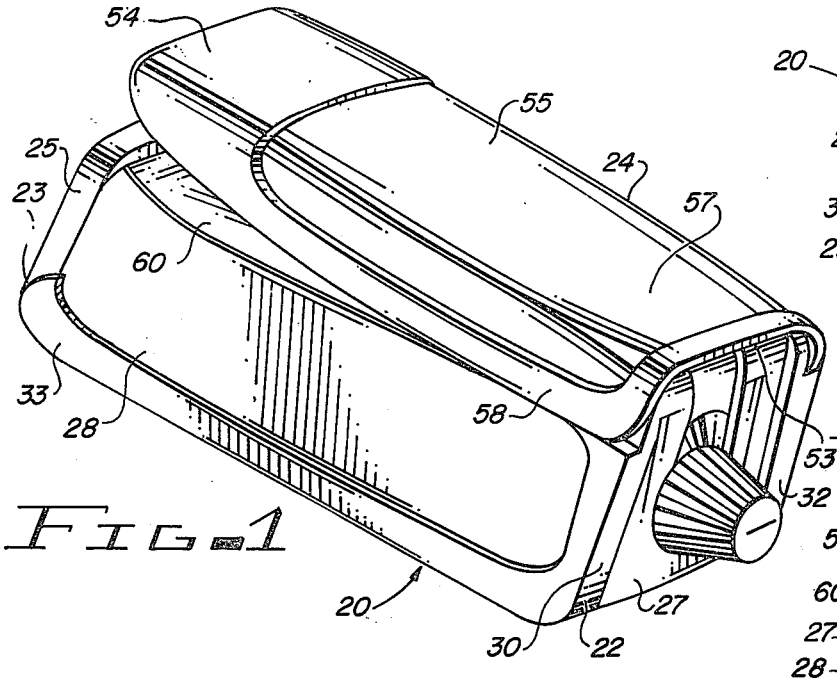
FIG. 1 is a perspective view of a dispenser constructed in accordance with the teachings of the instant invention.
Figure 2:
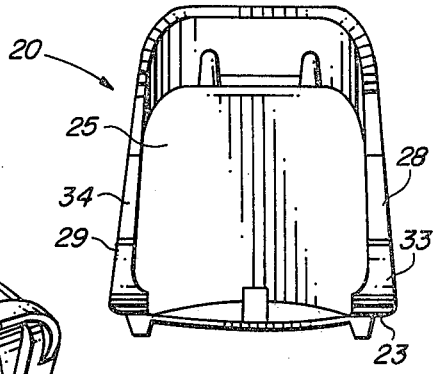
FIG. 2 is an elevation view of the rearward end of the device of FIG. 1, taken from the left-hand end of the illustration of FIG. 1.
Figure 3:
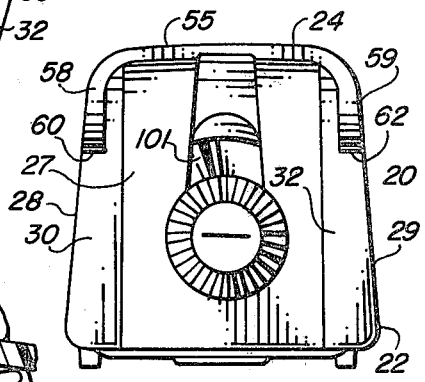
FIG. 3 is an elevation view of the forward end of the embodiment of FIG. 1, taken from the right-hand end of the illustration of FIG. 1.

Turning now to the drawings in which like reference characters indicate corresponding elements throughout the several views, attention is first directed to FIG. 1 which shows a dispensing device, embodying the principles of the instant invention, including a housing generally designated by the reference character 20 having a forward end 22 and a rearward end 23. As will described presently in further detail, associated with housing 20 is an actuating element 24, which also functions as a cover, a door 25 carried at the rearward end as illustrated in FIG. 2 and a forward end wall 27 further seen in FIG. 3.

Figure 4:
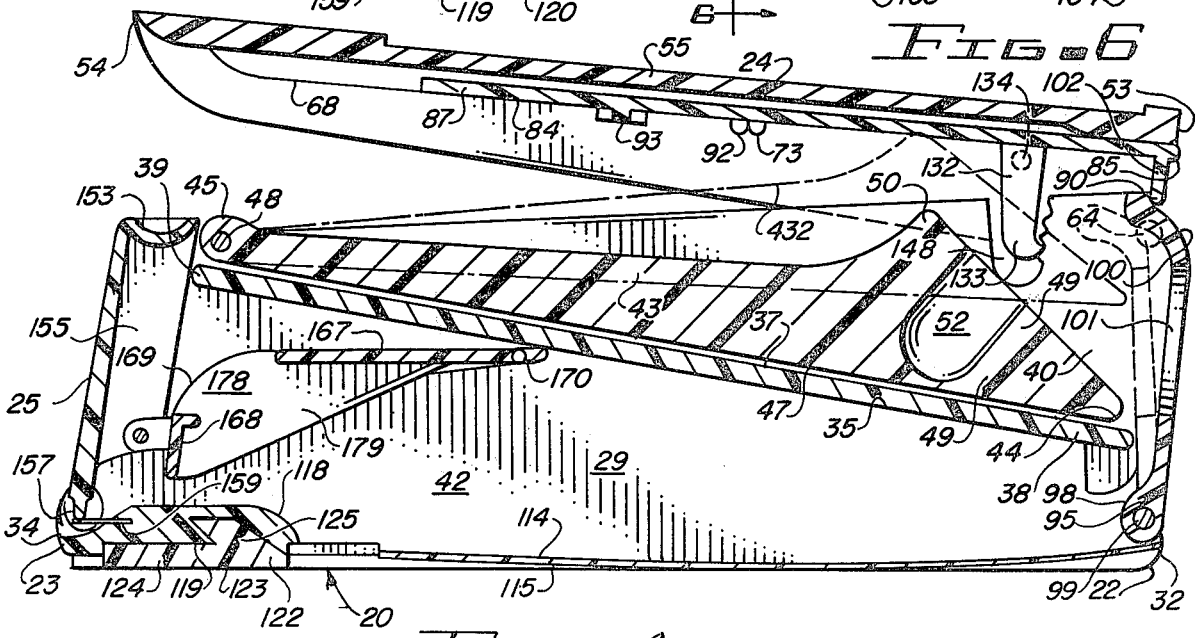
FIG. 4 is an enlarged vertical sectional view taken along the line 4—4 of FIG. 1.

With further reference to FIG. 4, it is seen that housing 20 includes a pair of spaced apart mirror image side walls 28 and 29 with forward ends 30 and 32, respectively, and rearward ends 33 and 34, respectively. Forward ends 30 and 32 correspond with forward end 22 of housing 20 while rearward ends 33 and 34 correspond with rearward end 23 of housing 20. An anvil 35 having upper surface 37, extends longitudinally of housing 20 between side walls 28 and 29. Surface 37 is inclined having a forward end 38 residing at a lower position than rearward end 39. With respect to the vertical, anvil 35 is located at intermediate position of sides 28 and 29 thereby dividing housing 20 into an upper compartment 40 and a lower compartment 42. Upper compartment 40, not having a top, may be considered to be a receptacle or a trough.

Lever means carried by housing 20 and opposing anvil 35, the purpose of which will be described in further detail later, includes previously referenced actuating element 24 and presser element 43. Presser element 43 is elongate having forward end 44, rearward end 45 and lower surface 47. Pin 48 pivotally connects rearward end 45 of presser element 43 to sides 28 and 29 proximate rearward end 23 of housing 20. It is noted that forward end 44 of presser element 43 terminates approximately coincident with forward end 38 of anvil 35.

Inclined surface 49 extending upwardly rearward from forward end 44 of presser element 43 terminates with an upwardly directed apex or ridge 50. Ridge 50, as further seen in FIG. 14, extends laterally along the presser element 43 and forms a contact element for actuating element 24 as will be described presently. Blind hole 52, extending into presser element 43 from surface 49, serves as a finger grip for manual manipulation of presser element 43. During movement of presser element 43 about pivot pin 48, surface 47 is angularly displaced relative surface 37 of anvil 35. While the positions of presser element 43 are infinitely variable, a representative alternate position is illustrated by the broken outline designated 43A.

Being elongate, actuating element 24 includes forward end 53, rearward end 54 and central section 55 having upper surface 57. Actuating element 24 further includes down-turned side sections 58 and 59 integral with central section 58. Down-turned side sections 58 and 59 straddle housing 20 and preferrably are received within recesses 60 and 62 formed in the upper portion of sides 28 and 29, respectively. Actuating element 24 is pivotally connected proximate the forward end thereof to housing 20 proximate the forward end thereof by pins 63 and 64. Pin 63 connects side section 58 to side 62 while pin 64 connects side section 59 to side 29. As will be recognized by those skilled in the art, each pin 63 and 64 may be affixed to one of the respective elements and journeled within the other. From the foregoing description, it is apparent that downward pressure, in the direction of arrowed line A, exerted upon presser element 43 brings actuating element 24 into contact with ridge 50 urging presser element 43 toward anvil 35.

Figure 15:
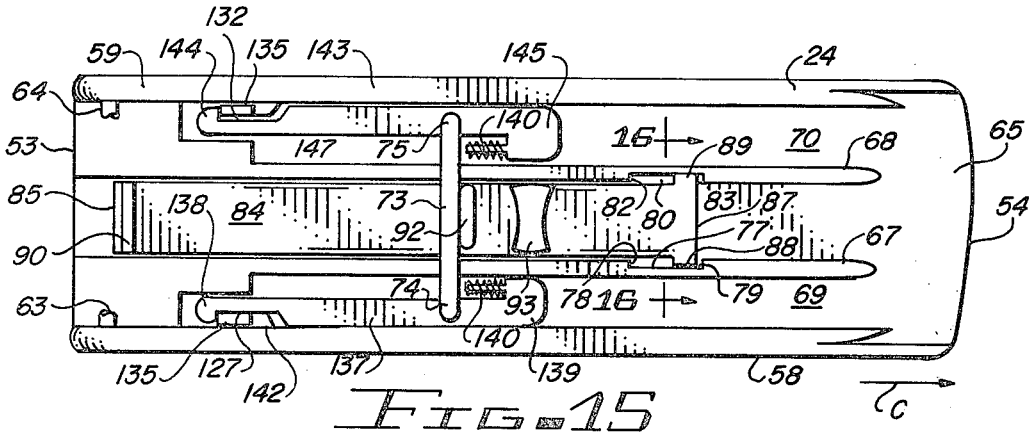
FIG. 15 is a bottom plan view of the top pivotally mounted element partially seen in FIG. 14.
Figure 16:
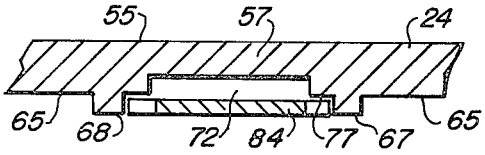
FIG. 16 is an enlarged fragmentary vertical sectional view taken along the line 16—16 of FIG. 17.

Actuating element 24 also includes an under-surface 65 as further illustrated in FIG. 15. A pair of spaced apart upstanding ribs 67 and 68 extend longitudinally of under-surface 65. Rib 67 is spaced from side section 58 to form slot 69 therebetween. Similarly, rib 68 is spaced from side section 59 to form slot 70 therebetween. Surface 65, intermediate ribs 67 and 68 are depressed to form groove 72 as specifically seen in FIG. 16. During contact of actuating element 24 with presser element 43, ribs 67 and 68 bear upon ridge 50.

Figure 18:
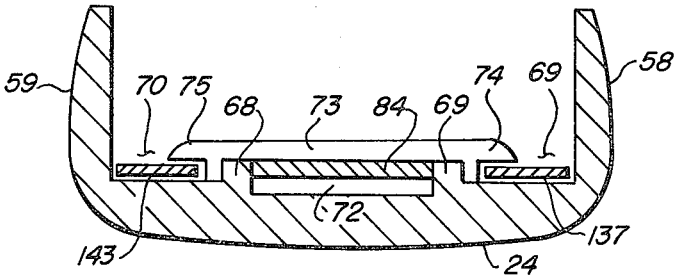
FIG. 18 is a vertical sectional view taken along the line 18—18 of FIG. 15.

Bar 73, having ends 74 and 75, is affixed to and carried by ribs 67 and 68 at an intermediate position thereof. As specifically seen in FIG. 18, bar 73 extends across groove 72 and a portion of each slot 69 and 70. That is, end 74 terminates intermediate side section 58 and rib 69 and end 75 terminates intermediate side 59 and rib 68. A rabbet 77, having forward end 78 and rearward end 79, is formed in rib 67 intermediate bar 73 and end 54 of actuating element 24. Rabbet 80, having forward end 82 and rearward end 83, is formed in rib 68 opposite rabbet 77.

An adjusting element in the form of elongate bar 84, having forward end 85 and a rearward end 87, is slidably disposed between ribs 67 and 68. Ears 88 and 89, projecting outwardly from bar 84 proximate forward end 87, slidably reside within rabbets 77 and 80, respectively. Downwardly directed tang 90 extends from forward end 82. Stop element 92 and finger tab 93 also depend from bar 84.

The spacing between stop element 92 and the ears 88 and 89 is such that with ears 88 and 89 abuting forward ends 78 and 82 of rabbets 77 and 80, respectively, stop element 92 abuts the rearward side, that is, in the direction facing rearward end 54 of actuating element 24, of bar 73. Accordingly, bar 84 is locked into place and cannot move in either direction, forwardly or rearwardly, with respect to actuating element 24. Bar 84 is substantially rigid. However, bar 84 is sufficiently flexible that when grasped by finger tab 93, it can be depressed into groove 72 sufficiently to pass stop element 92 to the other side of bar 73. The combined thickness of bar 73 and stop element 92 corresponds to the length of movement of ears 88 and 89 within the respective rabbets 77 and 80. Accordingly, when ears 88 and 89 are in contact with forward ends 78 and 82 of rabbets 77 and 80, respectively, stop element 92 abuts the forward side of bar 73 and bar 84 is restrained against longitudinal movement.

In accordance with the foregoing description, it is seen that bar 84 is movable between two selective positions. The purpose, thereof, is the positioning of tang 90 between a first position and a second position. The first position is defined as a forward position in which ears 88 and 89 abut forward ends 78 and 82, respectively. The second position is defined as a rearward position in which ears 88 and 89 are in contact with rearward end 79 and 83, respectively.

Forward end wall 27 includes inner surface 94, outer surface 95, upper end 97 and lower end 98. Lower end 98 is pivotally connected to housing 20 by pin 99. An arcuate groove 100 is formed in outer surface 95 proximate upper end 97. Groove 100, which has a width sufficient to receive tang 90, terminates at the upper end with shoulder 102 against which tang 90 abuts. In response to the positioning of bar 84, forward end wall 27 is movable between a first position shown in solid outline in FIG. 4 and a second position shown in the broken outline designated 27A. An opening 101, elongated in the upright direction extends through wall 27. The function provided by movable forward end wall 27 will be discussed presently.

Figure 6:
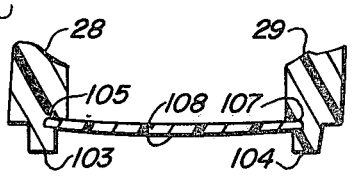
FIG. 6 is a fragmentary vertical sectional view taken along the line 6—6 of FIG. 5.

Side walls 28 and 29 terminate with lower edges 103 and 104, respectively, upon which housing 20 normally rests, as clearly illustrated in FIG. 6. A slot 105, as further seen with reference to FIG. 9, extends along the inner surface of side 28 proximate lower end 103. An opposing slot 107 extends along side 29 proximate lower end 104. Slots 105 and 107 are open at the forward ends of the respective side walls. Panel 108, having forward lateral edge 109, rearward lateral edge 110, also includes longitudinal edges 112 and 113 which are slidably held within slots 105 and 107, respectively.

Panel 108, which functions as a drip tray, is dished. That is, panel 108 includes a top surface 114, the central section of which is lower than the edges 109, 110, 112 and 113. Depending from bottom surface 115 of panel 108 is a finger grip 117 which is used to move panel 108 forwardly and rearwardly as illustrated by the double arrowed line B for the purpose of separation or installation, respectively. FIG. 9 illustrates panel 108 in an intermediate position.

Housing 20 is also adapted to be suspended in a position such that forward end wall 27 is directed downwardly. For this purpose, housing 20 is provided with cross member 118 proximate rearward end 23 as specifically illustrated in FIGS. 4, 5 and 9. Recess 119 and upwardly rearwardly directed lateral slot 120 are formed in the under-surface of cross member 118. Hanger bracket 122 having bottom surface 123 substantially lying in the plane of lower edges 103 and 104 of sides 28 and 29, respectively, is attachable to a vertical surface or wall by screws, adhesive or other conventional fastening means. Hanger bracket 122 further includes a substantially planar body portion 124 which is received in recess 119 and a projecting lip 125 which is matingly received within slot 120. Housing 20 is, therefore, removably held in the suspended position by hanger bracket 122.

Figure 17:
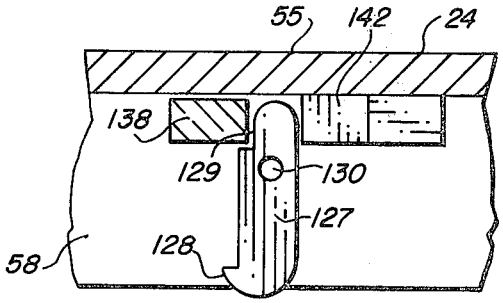
FIG. 17 is an enlarged fragmentary vertical sectional view taken along line 17—17 of FIG. 15.

Detent means prevent actuating element 24 from pivoting about pin 64 and falling downwardly when housing 20 is held in the suspended position by hanger bracket 122. The detent means, which is especially seen with reference to FIGS. 4, 15 and 17, includes pawl 127, having projection 128 proximate the lower end thereof and recess 129 proximate the upper end thereof, which is pivotally connected to the inner side of side section 58 of actuating element 24 by pin 130. A second similar pawl 132 having projection 133 is analogously pivotally connected to side section 59 by pin 134. Each pawl 127 and 132 is spaced from the surface of the respective side section by a spacer 135.

A latch bar 137 having hooked forward and rearward ends 138 and 139, respectively, slidably resides within slot 69. Compression spring 140 abuts hooked rearward end 139 and a projection from rib 67 (not herein specifically illustrated) to urge latch bar 137 rearwardly as indicated by the arrowed line C. Forward hooked end 138 bears against recess 129 urging the upper end of pawl 127 rearwardly against stop 142. As specifically noted in FIG. 18, latch bar 137 resides under the end 74 of bar 73. A similar latch bar 143 having forward hooked end 144 and rearward hooked end 145 in response to a second spring 140 urges second pawl 132 against stop 147.

Figure 14:
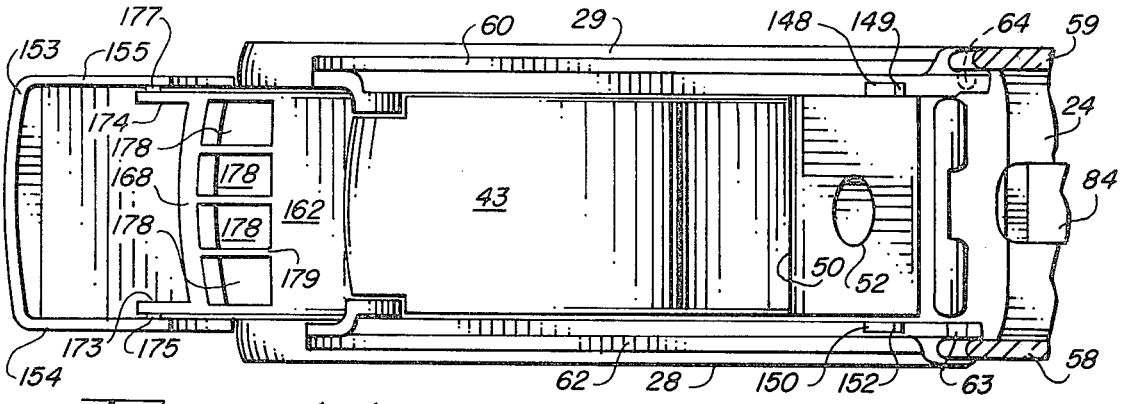
FIG. 14 is a top plan view of the device of FIG. 1 illustrated as it would appear with the door open, as seen in FIG. 5, and with the top pivotally mounted element swung forwardly and broken away.

Attention is now directed to FIG. 14 which shows a recess 148 formed in the inner surface of side wall 29 of housing 20 and sized and shaped to receive pawl 132. Along one edge of recess 148 are a plurality of teeth 149 spaced along an arc having pin 64 as the center thereof. As actuating element 24 is moved in the direction of arrowed line A, projection 133 of pawl 132 is urged into engagement with the appropriate tooth 149. A similar recess 150, having teeth 152, as seen in FIG. 14, is formed in side wall 28 for analogous interaction with pawl 127. Springs 140 are selected to have a strength such that actuating element 24 is readily movable manually, but will not pivot about pins 63 and 64 in response to gravity.

Figure 5:
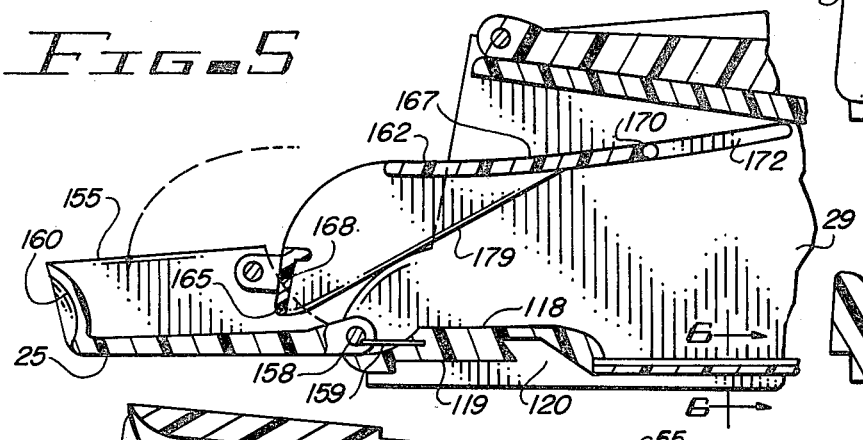
FIG. 5 is a fragmentary portion of the rearward end of the illustration of FIG. 4 except showing the door in an open position.

Door 25, as specifically illustrated in FIGS. 4, 5 and 14, includes inwardly directed upper edge 153, inwardly directed side edges 154 and 155 and bottom edge 157. Pins 158 proximate lower edge 157, one of which is illustrated in FIG. 5, pivotally connect door 25 to housing 20. Flat spring 159 extending from cross member 118 bears against floor edge 157 to hold door 25 in a closed position as seen in FIG. 4 or an open position as seen in FIG. 5. The use of a flat spring for the immediate purpose is well known and will be readily apparent to those skilled in the art. Recess 160 formed in upper edge 153 accommodates the user's finger for moving door 25 between the positions.

Various objects having a relationship to the fluent material being dispensed by the device of the instant invention, may be stored in lower compartment 42. The items are deposited or retrieved through the opening provided by door 25. Additional structure, useful in connection with the device of the instant invention for the purpose of storing toothbrushes when the fluent material is toothpaste, will now be described in detail. A toothbrush holder 162, holding a toothbrush shown in broken outline 163, is shown in FIG. 5.

Toothbrush holder 162, having forward end 164 and rearward end 165, as further illustrated in FIGS. 4 and 14, includes forward section 167 and rearward section 168 separated by intermediate arcuate section 169. Pin 170, carried proximate forward end 164, projects outwardly in opposite lateral directions from first section 167. The pin 170, at opposite ends thereof, travels within respective ones of a pair of opposed grooves 172 formed in sides 28 and 29. Only groove 172 in side 29 is illustrated in the drawings, however, it will be appreciated that the groove 172 in side 28 is a mirror image. Rearward section 168 is pivotally connected to door 25 by rearwardly extending ears 173 and 174 which are connected to inwardly directed sides 145 and 155, respectively, by pins 175 and 177, respectively.

A plurality of openings 178 are spaced laterally along toothbrush holder 162 in the area of intermediate arcuate section 169. A substantially vertical divider plate 179 is carried between each opening 178. A similar plate 179 is carried outward of each opening 178 along the lateral edges of toothbrush holder 162. Toothbrush 163, as seen in FIG. 5, is typical of a conventional commercially available brush having an elongate stem 180 functioning as a handle at one end thereof and carrying a cluster of bristles 182 at the other end thereof. Each opening 178 is sized and shaped to receive stem 180 therethrough. Stem 180 bears upon rearward section 168 while bristles 182 abut forward section 167. As will be obvious from viewing FIGS. 4 and 5, toothbrush holder 162 is extended and retracted relative housing 20 in response to opening and closing, respectively, door 25. In the retracted position, especially illustrated in FIG. 4, the entire toothbrush, including the cluster of bristles, will be contained within compartment 42. Upon opening the door, as seen in FIG. 5, a portion of the toothbrush will be extended from compartment 42 for convenient access by the user.

Those familiar with the use of toothbrushes will readily recognize that minor amounts of water are present after use and are carried by the toothbrush into storage. While some of the water will evaporate, some of the water will fall from the toothbrush in the form of droplets. Droplets falling from the toothbrush will be caught by the dished panel 108 and will evaporate therefrom inside of falling upon and staining the surface upon which the device of the instant invention rests. It is noted that panel 108 is readily removable for periodic cleaning. It is also pointed out that due to the thickness of divider plates 179, the several toothbrushes held within openings 178, are maintained in a spaced relationship.

FIG. 11 illustrates a replacement cap 183 to replace the conventionally supplied cap for a tube or collapsible container. Replacement cap 183 increases the convenience and the utility of the device of the instant invention. Fabricated of plastic, latex or other resilient material, cap 183 includes a body 184 having a knurled, truncated, conical outer surface 185 and forward and rearward ends 187 and 188. Extending inwardly from rearward end 188 is bore 189 which is engagable over the discharge spout 190 of conventional collapsible container 192. While bore 189 may be provided with an internal thread to matingly receive the external thread typically carried by discharge spout 190, it is not deemed necessary. Due to the resiliency and flexiability of the material of construction of cap 183, bore 189 may be smooth and with minimal pressure forced over discharge spout 190 until shoulder 193 abuts the ends 194 of discharge spout 190. Forward the shoulder 193, bore 189 includes tapered section 195 terminating with slit 197 at forward end 187.

As will be apparent to those skilled in the art, and as further partially illustrated in FIG. 12, collapsible container 192, in addition to discharge spout 190, includes collapsible body 198 having open end 199 across which extends header wall 200. A fluent material 202 is contained within collapsible container 192. In accordance with conventional practice, the other end of collapsible body 198 is closed, generally by sealing along a lateral line. As collapsible body 198 is squeezed and collapsed, the fluent material 202 is discharged through tubular discharge spout 190.

FIG. 12 shows a conventional tube 192 having the replacement cap 183 of the instant invention secured thereto as it would appear at a time when no pressure is being applied to collapsible body 198. FIG. 13 illustrates the arrangement of the elements described in connection with FIG. 12 as they would appear during the time pressure is applied to collapsible body 198 in accordance with the conventional squeezing method of discharging contents from a conventional collapsible container 192. Fluent material 202 from body 198 passes through discharge spout 190 into tapered section 195 of bore 189. In response to the pressure of fluent material 202, slit 197 expands and opens allowing the fluent material 202 to pass therethrough. When pressure upon collapsible body 198 is relaxed, the components will assume the configuration illustrated in FIG. 12.

The utility, function and operation, of the device of the instant invention for holding a conventional collapsible tube and dispensing fluent material therefrom will not be described in detail. Preparation for insertion of the collapsible tube begins by lifting actuating element 24 upwardly and forwardly causing pivotal movement about pins 63 and 64 in a direction counter to arrowed line A. The movement is continued until actuating element 24 is brought to rest in the fully forward position as seen in the illustration of FIG. 14. By inserting a finger in blind hole 52, pressure element 43 pivoting about pin 48 is moved upwardly rearward until a rest position is assumed. The selected tube or collapsible container is then examined to determine the material of construction, metal or plastic. If the tube is plastic, elongate bar 48 is set in the first or forward position. If the tube is metal, elongate bar 84 is placed in the second or rearward position.

Next, the collapsible container is introduced into upper compartment 40. The tube is oriented with the collapsible body resting upon the inclined upper surface 37 of anvil 35 with the discharge spout projecting through opening 101. It is natural that the closed end, sealing line, of the collapsible body will be oriented to extend laterally. Due to the inclination of surface 37, the collapsible container will slide forwardly of forward end 38 and abut forward end wall 27. It is further noted that the discharge spout will reside at an intermediate or upper position within elongate opening 101.

Presser element 43 is then pivoted forwardly and downwardly coming to rest upon the deformable body of the collapsible container. Subsequently, actuating element 24 is pivotally moved in the direction of arrowed line A until ribs 67 and 68 bear upon ridge 50. Concurrent therewith, pawls 127 and 132 will enter the respective recesses 148 and 150. Projections 128 and 133 will randomly engage teeth 149 and 152, respectively. The device is now prepared for use. If desired, the cap of closure member is supplied by the manufacturer, may be removed from the discharge spout of the collapsible container and replaced by replacement cap 183.

During use, the intended recipient of the fluent material is positioned adjacent the discharge spout and pressure applied to actuating element 24 in the direction of arrowed line A until the desired quantity of fluent material has been dispensed. During the application of pressure, actuating element 24 urges pressure element 43 toward anvil 35 collapsing the deformable body therebetween. It is important to note that surface 47 of actuating element 24 moves arcuately relative surface 37 of anvil 35 during the dispensing cycle. The rearward end 45 of presser element 43 is nearly coincident with the rearward end 39 of anvil 35. Accordingly, as presser element 43 moves toward anvil 35 a point on surface 47 closer to end 45 will approach a corresponding point on surface 37 more rapidly than a point on 47 nearer end 44. This phenomenon, as will be readily understood by those skilled in the art, results in progressive collapsing of the deformable body from the closed end thereby constantly urging the fluent material toward the header wall. This insures that all fluent material will be moved towards the discharge spout and eliminates bypassed pockets of fluent material.

FIG. 7 further illustrates the use of the device of the instant invention in combination with a conventional collapsible container fabricated of metal having collapsible body 198M, header wall 200M and discharge spout 190M. Since the side wall is of uniform rigidity and the fluent material is of uniform density, the presser element and the anvil will cause equal deformation. The tube is specifically illustrated as being partially collapsed after a substantial portion of the fluent material 202 has been discharged. Accordingly, discharge spout 190M moves downwardly within elongate opening 101 as the tube is collapsed.

Elongate bar 84 and forward end wall 27 are in the rearward position as denoted by the arrowed line D. The distance between inner surface 94 of forward end wall 27 and the ends 38 and 44 of anvil 35 and presser element 43 is not substantially greater than the thickness of the material of header wall 200M combined with the thickness of side wall 198M. Accordingly, header wall 200M and a portion of side wall 198M will wrap around the ends 38 and 44 as illustrated. This provides for maximum discharge of the fluent material 202. When empty, the collapsible container is removed by first moving actuating element 24 to the forward position, previously described, releasing tang 90 from engagement with shoulder 102 and locating tang 90 at a spaced position from wall 27. Accordingly, wall 27 can be moved forwardly sufficiently for disengagement of header wall 200M from ends 38 and 44. Finally, presser element 43 may be lifted, as previously described, for removal of the collapsible container from compartment 40.

FIG. 8 illustrates the dispenser of the instant invention in use in combination with a collapsible container fabricated of plastic and having collapsible body 198P, header wall 200P and discharge spout 190P. Elongate bar 84 is in the first, or forward, position as denoted by the arrowed line E. Forward end wall 27, with shoulder 102 abuting tang 90, is spaced further from ends 38 and 44 than in the illustration of FIG. 7. Essentially, the function is analogous to that previously described in connection with FIG. 7. The space between the forward end 38 of anvil 35 and the interior surface 94 of forward end wall 27, provides a cavity or recess for receiving header wall 200P. Since a plastic collapsible container will separate between the deformable body and the header wall if squeezed close to the header wall as illustrated in FIG. 7, the extra spacing between ends 38 and 44 and wall 27 is necessary. It will be appreciated that a small quantity of fluent material 202 adjacent header wall 200P will remain after deformable body 198P has been totally collapsed.

Various modifications and variations of the embodiment of the invention herein chosen for purposes of illustration will readily occur to those skilled in the art. To the extent that such modifications and variations do not depart from the spirit of the invention, they are intended to be included within the scope thereof which is limited only by a fair interpretation of the following claims.

Having fully described and disclosed the present invention in such clear and concise terms as to enable those skilled in the art to understand and practice the same, the invention claimed is:

1. A dispenser for holding a collapsible tube which tube includes a deformable body having a continuous side wall, a closed end, and an open end, a header wall closing the open end of the body and a discharge spout projecting from said header wall; said dispenser squeezing a fluent material from the tube, said dispenser comprising:

a housing having a forward end and a rearward end;

an anvil extending longitudinally within the housing for supporting said tube, said anvil having an inclined surface for supporting the deformable body of the collapsible tube and having a rearward end and a forward end, said rearward end being elevated above said forward end;

lever means carried by said housing and opposing said anvil for progressively collapsing the deformable body of the collapsible tube from the closed end thereof and urging said fluent material from the discharge spout; said lever means including an elongate presser element angularly movable relative to the anvil, and an actuating element carried by the housing for urging the presser element toward the anvil; said presser element having a forward end and a rearward end, the rearward end being pivotally connected proximate the rearward end of the housing; said presser element having a surface opposing inclined surface of the anvil for bearing upon said deformable body and having a forward end approximately coincident with the forward end of the inclined surface and having a rearward end; said actuating element having a forward end and a rearward end, the forward end being pivotally connected proximate the forward of the housing; a contact element upstanding from the presser element for receiving the actuating element thereagainst, the contact element including a ridge extending transversely of said presser element; said ridge being positioned closer to the forward end of the presser element than the rearward and contacting said actuating element at a position closer to the forward end of the presser element than the rearward end thereof;

an upright forward end wall mounted on the housing and spaced from the forward ends of the respective surfaces of the anvil and the presser element for receiving the header wall of the collapsible tube thereagainst, said forward end wall including an upper edge, a lower edge and an opening for receiving said discharge spout therethrough, said opening through the forward wall being elongated in the upright direction; pivot means proximate the lower edge of said forward end wall pivotally connecting said wall to said housing; and adjustment means for selectively varying the angular position of said forward end wall about said pivot means between a first position and a second position, said forward end wall residing farther from the ends of the respective surfaces of said anvil and said presser element in said first position than in said second position.

2. The dispenser of claim 1, wherein said adjustment means includes an adjusting element carried by said actuating element and engagable with said forward end wall.

3. The dispenser of claim 2, wherein said adjustment means includes:

(a) an adjusting element carried by said actuating element and selectively slidably movable between a forward position and a rearward position;

(b) locking means for alternately locking said adjusting element in said forward position or in said rearward position; and (c) means engaging said adjustment element with said forward end wall.

4. The dispenser of claim 3, wherein said means engaging said adjustment element with said forward end wall includes:

(a) a shoulder carried by said forward end wall proximate the upper edge thereof; and (b) a tang depending from said adjusting element and abuting said shoulder.

5. The dispenser of claim 3, wherein said means engaging said adjustment element with said forward end wall is disengaged when said actuating element is pivotally moved in an upwardly forward direction.

6. The dispenser of claim 3, wherein said locking means includes:

(a) a slot formed in said actuating element and having a forward end and a rearward end;

(b) an ear carried by said adjusting element and residing within said slot;

(c) a bar carried by said actuating element and having a forward side and a rearward side; and (d) a stop projection from said adjusting element and selectively alternately abutable against the forward side or rearward side of said bar said stop abuting the forward side of said bar and said ear bearing against the forward end of said slot when said actuating element is in the forward position; and said stop abuting the rearward side of said bar and said ear bearing against the rearward end of said slot when said actuating element is in the rearward position.

7. A dispenser for holding a collapsible tube having a deformable body, a header wall and a discharge spout projecting from said header wall, and for squeezing a fluent material from such a tube comprising:

a housing within which a collapsible tube is adapted to be positioned, said housing having a forward end wall pivotally mounted on said housing, said end wall having an opening for receiving the discharge spout of a collapsible tube therethrough and adapted to have the header wall of a collapsible tube positioned thereagainst;

means for progressively collapsing the deformable body of a collapsible tube to squeeze fluent material from the deformable body through the discharge spout; and means for selectively varying the angular position of the end wall relative to said housing to vary the distance between the end wall and the means for progressively collapsing the deformable body of a collapsible tube.

8. The dispenser of claim 7 in which the means for selectively varying the angular position of the end wall varies the angular position of the end wall between a first position and a second position.

9. A dispenser for holding a collapsible tube, which tube includes a deformable body having a continuous side wall, a closed end, an open end, a header wall closing the open end of said body, and a discharge spout projecting from said header wall and for squeezing a fluent material from said tube, said dispenser comprising:

a housing having a forward end and a rearward end;

an anvil extending longitudinally within said housing for supporting said tube;

lever means carried by said housing and opposing said anvil for progressively collapsing and deformable body from the closed end thereof and urging said fluent material from said discharge spout;

an article storage compartment formed in said housing including a pair of spaced apart side walls, a top defined by said anvil, and a rearwardly directed opening;

a door pivotally carried by said housing proximate the rearward end thereof for closing said opening;

an article holding element movably carried within said compartment and having a rearward end affixed to said door, said article holding element residing within said compartment when said door is in a closed position, and said article holding element projecting through said rearwardly directed opening when said door is in an open position.

10. The dispenser of claim 9 further including spring means for selectively retaining said door in said closed position and in said open position.

11. A dispenser for holding a collapsible tube, which tube includes a deformable body having a continuous side wall, a closed end, and an open end, a header wall closing the open end of said body; and a discharge spout projecting from said header wall and for squeezing a fluent material from said tube, said dispenser comprising:

a housing having a forward end end and a rearward end, an anvil extending longitudinally within the housing for supporting said tube;

lever means carried by said housing and opposing said anvil for progressively collapsing said deformable body from the closed end thereof and urging said fluent material from said discharge spout;

an elongate presser element angularly movable relative to said anvil;

an actuating element carried by said housing for urging said presser element toward said anvil;

said presser element including a forward end and a rearward end pivotally connected proximate the rearward end of said housing;

said actuating element including a forward end pivotally connected proximate the forward end of said housing and a rearward end;

detent means opposing pivotal movement of said actuating element about the pivotally connected forward end thereof;

a plurality of spaced apart teeth carried by said housing;

a pawl pivotally carried by said actuating element and sequentially engagable with each of said plurality of teeth; and biasing means for urging said pawl into engagement with each of said plurality of teeth.

12. A dispenser for holding a collapsible tube, which tube includes a deformable body having a continuous side wall, a closed end, an open end, a header wall closing the open end of said body, and a discharge spout projecting from said header wall, and for squeezing a fluent material from said tube, said dispenser comprising:

a housing having a forward end and a rearward end;

an anvil extending longitudinally within said housing for supporting said tube;

lever means carried by said housing and opposing said anvil for progressively collapsing said deformable body from the closed end thereof and urging said fluent material from said discharge spout;

an article storage compartment formed in said housing and including a pair of spaced apart side walls, a top defined by said anvil, and a rearwardly directed opening;

a door pivotally carried by said housing proximate the rearward end thereof for closing said opening;

a pair of opposed grooves, one carried by each of said pair of side walls;

a holder normally residing within said compartment and including a forward end, a rearward end and article holding means intermediate said ends;

a pair of pins carried proximate the forward end of said holder, each of said pair of pins being slidably disposed within a respective one of said pair of grooves; and means carried proximate the forward end of said holder pivotally connected to said door.

* * * * *